US006732783B2

(12) United States Patent
Bouldin

(10) Patent No.: US 6,732,783 B2
(45) Date of Patent: May 11, 2004

(54) MASS MARKETABLE DECORATIVE WINDOW TREATMENTS

(76) Inventor: Susan Smith Bouldin, 2908 Ramsgate Ct., Winston-Salem, NC (US) 27106

( * ) Notice: Subject to any disclaimer, the term of this patent is extended or adjusted under 35 U.S.C. 154(b) by 0 days.

(21) Appl. No.: 10/243,022

(22) Filed: Sep. 13, 2002

(65) Prior Publication Data

US 2003/0051831 A1 Mar. 20, 2003

Related U.S. Application Data

(60) Provisional application No. 60/322,954, filed on Sep. 18, 2001, provisional application No. 60/354,759, filed on Feb. 5, 2002, and provisional application No. 60/371,001, filed on Apr. 9, 2002.

(51) Int. Cl.[7] ..... A47H 13/14
(52) U.S. Cl. ..... 160/348
(58) Field of Search ..... 160/348, 84.01, 160/84.04, 330, 38, 123, 124; 16/87 R, 87.2, 87.4 R; 24/116

(56) References Cited

U.S. PATENT DOCUMENTS

| | | | | | |
|---|---|---|---|---|---|
| 1,778,449 | A | * | 10/1930 | King | 160/123 |
| 2,352,531 | A | * | 6/1944 | Gallo | 160/348 |
| 2,547,697 | A | * | 4/1951 | Gallo | 160/348 |
| 2,587,492 | A | * | 2/1952 | Lipetz | 160/124 |
| 2,609,043 | A | * | 9/1952 | Dubinsky | 160/124 |
| 2,666,481 | A | * | 1/1954 | White | 160/348 |
| 3,996,987 | A | | 12/1976 | Rodriguez | |
| 4,865,105 | A | * | 9/1989 | Peters | 160/38 |
| 4,960,161 | A | * | 10/1990 | Easley | 160/126 |
| 5,074,348 | A | | 12/1991 | Phillips | |
| 5,094,006 | A | | 3/1992 | Varney | |
| 5,191,922 | A | * | 3/1993 | Wade | 160/124 |
| 5,230,375 | A | * | 7/1993 | Linder | 160/39 |
| 5,259,520 | A | * | 11/1993 | Roggio et al. | 211/105.1 |
| 5,598,880 | A | * | 2/1997 | Cross | 160/38 |
| 5,673,741 | A | | 10/1997 | Cairns | |
| 5,894,642 | A | * | 4/1999 | Eberhardt | 24/716 |
| 6,173,753 | B1 | | 1/2001 | Laster-Bivens et al. | |
| 6,192,962 | B1 | | 2/2001 | Glover | |

OTHER PUBLICATIONS

ADO International—Retail Price Lists and Catalogs All Products, Effective Jul. 1, 2000, pp 49, 51–56.

* cited by examiner

*Primary Examiner*—David Purol
(74) *Attorney, Agent, or Firm*—Robert W. Pitts

(57) ABSTRACT

A mass marketable decorative window treatment system employs adjustable-width and adjustable-length valance pieces that can be hung from a conventional curtain rod on which a rod sleeve has been mounted. Hook and loop fasteners are employed on both the valance pieces and on a curtain rod subassembly so that the decorative window treatment components need not be permanently secured to a board as required with similar custom window treatments. The width and length of individual valance pieces, such as swags and balloons, can be adjusted so that the standard size components can be used for different size windows. Individual window treatment components can be mounted side by side or in overlapping relationship. A protective flap is provided so that exposed hook fasteners will not damage the fabric during cleaning.

20 Claims, 10 Drawing Sheets

MASS MARKETABLE DECORATIVE WINDOW TREATMENTS

CROSS REFERENCE TO PRIOR COPENDING PATENT APPLICATIONS

This application claims benefit of the following co-pending Provisional Patent Applications: U.S. Provisional Patent Application No. 60/322,954 filed Sep. 18, 2001; U.S. Provisional Patent Application No. 60/354,759 filed Feb. 5, 2002; and U.S. Provisional Patent Application No. 60/371,001 filed Apr. 9, 2002.

BACKGROUND OF THE INVENTION

1. Field of the Invention

This invention relates to decorative window treatments, such as valances, drapery panels and balloons that can be supported from conventional curtain rods and which can be adjusted for use in different applications. This invention also relates to the use of fastening means, such as hook and loop fasteners, for mounting window treatments or valances.

2. Description of the Prior Art

Custom made decorative window treatments, such as valances, balloons, panels or similar fabric window treatments tend to be relatively high in cost and therefore are confined to a relatively small market. These decorative window treatments are typically fabricated by a skilled seamstress or a drapery workroom at the request of an interior decorator. The individual fabric decorative window treatment is sized to fit a specific order, and it is typically nailed to a board that is semi-permanently attached above a window. Unlike common draperies, these decorative window treatment items are not mounted to conventional or standard curtain rods. However, the aesthetic characteristics of these decorative window treatments would make them highly desirable if they could be mass marketed and if they could be adjusted and mounted on a conventional curtain rod by a homeowner, without the need for expertise or more than ordinary skill. Mass marketable or mass produced items of this type are not readily available and are not believed to have been previously sold or marketed. Although attempts to provide an acceptable product, having at least some of these features, may have been made, it is believed that these earlier attempts have not been successful efforts to combine sufficient features to satisfactorily meet the requirements of a sufficiently large number of homeowners. A number of related efforts have been discussed in the following patents.

U.S. Pat. No. 5,074,348 discloses decorative swags that can be hung from a board that is in turn mounted on a wall in a permanent manner. A hook or loop attachment strip is mounted on the top of the board, and a mating loop or hook fastener on the swag is attached to the complementary board mounted attachment strip. Hook and loop fasteners are mounted on opposite sides of the swags for attachment to the board mounted attachment strip. Other elements, such as jabots also including hook and loop fasteners, can be placed either on top of or underneath adjacent swags. An alternate embodiment of continuously joined together swags arranged around a pole is also shown. Hook and loop fasteners can be attached at opposite ends of these swag segments to connect the segments end to end to form a continuous member that can be wrapped or draped around a pole. A fastening tape can also be mounted on the pole and the swags can be detachably fastened end to end to the pole. Significantly, different swag configurations are used for attachment to a board and for attachment to a pole. A conventional telescoping curtain rod appears not to be discussed with reference to either configuration.

U.S. Pat. No. 5,094,006 discloses a template for making a swag that purportedly can be hung by an ordinary householder who does not possess specialized skill or training. The swag can be hung from a touch and close fastener means, or alternative fasteners, located on the rear of a board. Each swag is cut from a template, and apparently the template must be adjusted in order to cut a separate swag having a different width. A single swag cannot therefore be adjusted to a different width. A curtain rod assembly for mounting one of these swags is shown in U.S. Pat. No. 5,673,741 to the top of the telescoping rod assembly where complementary hook and loop fasteners have been attached to both the swag and the curtain rod. U.S. Pat. No. 3,996,987 discloses a valance cover that can be attached to the inner side of an assembly comprising three flat, rigid, oblong members joined to one another or extending as a continuous piece at right angles to one another.

U.S. Pat. No. 5,067,542 discloses a supposedly ready-made swag and pleated jabot system. The swag comprises a curved, folded hanging piece secured to an elongated sleeve piece by a line of stitching. The sleeve piece extends beyond the ends of the hanging piece and an elongated open-ended pocket is formed between opposite ends of the swag. The swag and a similarly pocketed jabot can be hung in conventional fashion from conventional telescoping curtain rods. When the two are used together, the jabot is hung from a front rod and the swag is hung from a separate rear rod.

U.S. Pat. No. 6,192,962 discloses an adjustable telescoping support bar from which multiple window treatments can be hung from the same support bar. The support bar includes hook and loop type fastening means attached to all sides of the support bar for attaching the window treatments to the support bar.

Although these prior patents do show various means for attaching window treatments, such as valances including swags, cascades, jabots etc., from a support member, they do not disclose a system including adjustable window treatment member that can be mounted on a conventional telescoping curtain rod using hook and loop fastening means. Furthermore they do not disclose the use of a separate rod sleeve that can be mounted on a conventional curtain rod. Therefore these prior patents do not show a system in which standard components, suitable for mass production, can be used to decorate windows or other structures.

SUMMARY OF THE INVENTION

An adjustable-width valance support device is a simple apparatus for displaying decorative overlaying valance sections, all of which allow the home shopper to form top window treatments, i.e., valances, according to his tastes and the size of his particular window(s). The apparatus is either a telescoping rod with hook and loop type fastener on its back (i.e., the side which faces the wall or window) or a rod sleeve with hook and loop fastener on one or both sides. This rod sleeve then slips over and entirely covers the curtain rod or pole. The adjustable-width valance support device or variant is used to display valance sections which have the mating hook/loop fastener attached so they may be applied to the rod or onto each other to form the valance. One of the most popular of these valance sections is known as a swag. Prior art swags are typically made to be of specific dimensions with little to no on-site adjustment possible. An adjustable-width swag according to this invention is especially constructed in order to allow a variation of up to six inches in its own width. Then each swag so constructed can be adjusted on site to give a custom fit without having to be custom made.

DETAILED DESCRIPTION OF THE PREFERRED EMBODIMENTS

System Comparison

Figure 1:
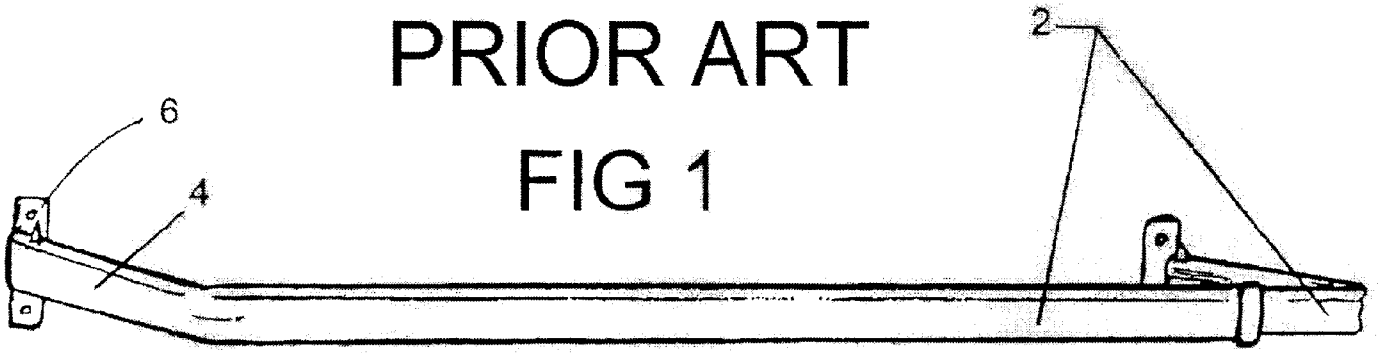
PRIOR ART FIG 1
FIG. 1 shows a conventional prior art Lockseam Curtain Rod from which the components of this window treatment system can be hung.

The term curtain rod has a well understood meaning in the context of the window or window treatment industry. Although there are many types of rods which hold up curtains (i.e., Canopy Rods, Continental Rods, Dauphine Rods, Sash Rods, Utility Rods, Valance Rods, Cut-To-Measure Rodding, etc.), one common curtain rod 2 sold wholesale by such manufacturers as Kirsch or Graber is a telescoping metal rod, which is U-shaped and comprises a combination of two L-shaped rod segments as shown in FIG. 1, and which is referred to as a conventional lockseam curtain rod 2. Conventional curtain rods of this or similar construction are readily available and are quite commonly used to hang most lightweight draperies. The bent ends 4 form corners and continue to become what is known as the return. These returns 4 come in different lengths from 1¼" to 5½" so that the rod 2 can project out from the wall the amount necessary to clear a blind or roller shade or the like. The end of this return 4 connects to a bracket 6 that is generally mounted onto a wall or window frame and/or casing. The rods are also available in different lengths (e.g. 18 "–28", 28 "–48", 48 "–84", 84 "–120"). Extender pieces allow an undetermined amount of coverage or length so that the rod 2 can be used with wide windows or with an array of windows. The commercially available lockseam curtain rod 2, shown in FIG. 1, measures ¾" from top to bottom.

The fabric window treatment system of the present invention can be used with conventional curtain rods 2, such as that shown in FIG. 1 or with alternative curtain rods, such as those that are not closed on the rear of the rod. In many cases, the consumer may already be using a Lockseam Curtain Rod", hich is available in various retail establishments and which the customer has purchased over the counter. The preferred embodiment of the instant invention incorporates a rod sleeve 10, shown in FIGS. 2–4 that permits a consumer to use a conventional curtain rod 2 to hang a decorative window treatment that will appear to hang in substantially the same way as a custom-made, board-mounted valance. The rod sleeve 2 is made from a heavy duty fabric with a hook and loop attachment system 12 on at least the rear side. The rod sleeve 10 fits snugly over the curtain rod 2 and is designed so that the rod 2 can be threaded through the tubular rod sleeve 10 so that the rod 2 is covered along its entire length. Although the rod sleeve 10 is most easily used with the Lockseam Curtain Rod 2, it can be adapted to fit other rods as well (the Canopy Rod, Continental Rod, Dauphine Rod, Sash Rod, Utility Rod, Valance Rod, Cut-To-Measure Rodding, etc.)

There is a definite need in today's market for adjustable-width valance pieces and for a rod sleeve 10 that will permit these valance pieces to be hung from an ordinary curtain rod. The type of top window treatments (valances) which can be bought over-the-counter today are rod pocket, tab or tie valances. Even if the prior art valance is made of swags or cascades, they are rod pocket swags and cascades which have a more casual, less sophisticated look. This "look" is inescapable with a rod pocket formation. A rod pocket is a tubular section of the fabric window treatment which extends from end to end and is readily noticeable at the top of the curtain or window treatment. Anything made with them is threaded onto a curtain rod or pole and mounted over a window or wall.

The curtain rod and rod pocket window treatment are popular for five main reasons: because they are available for purchase and immediate use, they are inexpensive as compared to custom treatments, they are adjustable to fit a wide range of window sizes, they are easy to put on the rod or pole (i.e., they are easy to mount), and they are easily installed.

With the adjustable-width valance pieces and the rod sleeve 10 of the preferred embodiment, the consumer has all of the advantages of availability, relatively low cost, adjustability, easy mounting, and easy installation plus he or she gets the custom look provided by the use of traditionally board- or pole-mounted window treatments, including swags, jabots, cascades, rosettes, horns, pelmets, or even a plain Roman shade valance, the rod in the same way that a custom window treatment would drop off a board.

With custom decorative fabric window treatments of this type, there is no rod pocket on any of the valance sections because the sections are stapled or nailed (or the like) to the top of the board or the back side of the pole. The rod pocket is unnecessary to suspend them. This board- or pole-mounted treatment is unavailable outside of the custom workroom. Custom window treatments are only available following a lengthy (and costly) design, fabrication and installation process. The consumer must find an interior designer, a custom workroom if he/she can find one (and these workrooms seldom take on work other than from designers), or a knowledgeable and skilled seamstress. Accurate and precise measurements must be taken. The design as well as the fabrics and trim must be chosen. The fabric and trim must either be ordered in by the designer, which often takes weeks or even months, or chosen by visits (most often multiple visits) to wholesale showrooms or retail fabric shops. Once the fabric is procured, it must be given to the actual fabricator. Depending upon several factors, the fabrication process alone rarely takes less than three weeks. For instance, once all the paperwork and information concerning design, application of trim, fabric used, type of lining and interlining, number of windows, etc. is in order, the valance pieces have to be cut (usually one at a time) and then sewn. The support apparatus, normally either boards or poles, must be cut to an exact length and, most often, covered with fabric or painted. Then the valance pieces are secured to the support by staples, nails, hook and loop fasteners, or the like. Once the window treatment itself is finished, a professional installer must be sought to mount the treatment properly. It is obvious that the customer must be prepared to wait for quite a long time between the time of the initial meeting with the designer and the glorious day of installation (and the sad day of the arrival of the bill).

In contrast, the adjustable valance pieces and rod sleeve 10, comprising the preferred embodiment of this invention, make feasible the mass production of valance sections, which solves the problem of availability. Valance sections of the same style can be cut in multiple layers and sewn in an assembly-line manner. The various sections (swags, jabots, cascades, rosettes, horns, pelmets, Roman shades, etc.,) are constructed with the hook or loop attachment surface at the top which mates to the hook or loop surface on the back of the rod sleeve 10. These mass-produced sections would be available for immediate purchase and installation. It is entirely possible that a customer could measure his or her windows, purchase the rod sleeve 10 if he/she already has a lockseam curtain rod, choose the sections appropriate for the size window and the desired "look", mount these sections, and install the support and resulting window treatment all in one afternoon.

The normal avenues for securing window treatments other than rod pocket or tab curtains are usually costly because of the labor intensity involved in measuring windows, selecting fabric, design, and fabrication of the finished product. In addition to its cost (often prohibitive to all but the most generous decorating budget), the process is quite time-consuming, usually requiring from six weeks up to several months from conception to installation, which ordinarily must be done by a professional installer whose work adds to the overall cost. The rod sleeve 10 will be relatively inexpensive when compared to the cost of fabricating and installing a custom valance board, even if the homeowner must also purchase a commonly available curtain rod, such as a lockseam curtain rod. The mass production of the valance components saves hours of labor and cuts costs dramatically enabling more people to afford them. Also, there is no time spent in cutting and/or covering the support apparatus, or mounting the valance sections on the board or pole, since this is left to the purchaser and is accomplished in minutes due to the hook and loop attachment system.

The third issue which the adjustable-width valance support device or a rod sleeve 10 addresses is that of adjustability. What is currently available (i.e., standardized Curtain Rods, Canopy Rods, Continental Rods, Dauphine Rods, Sash Rods, Utility rods or Valance Rods, etc.,) with their corresponding rod pocket valances have become popular because they can readily accommodate different width windows. They expand/contract to fit window widths within certain ranges. A specific measurement is not necessary for either the telescoping rod or the rod pocket valance for an appropriate fit and good look. A simple telescoping curtain rod with the hook or loop attachment and valance sections with the mating hook or loop attachment take care of this same fit issue in a custom way. By using the rod sleeve 10 the problem of fit for different windows is solved. The telescoping rod expands and supports or displays as many valance sections as needed to cover the desired area. This system enables the ordinary budget-conscious consumer to choose the number of pieces he or she needs to cover his or her window(s) and easily mount them him(her)self In addition, the consumer can choose from a number of different accessories (ropes, knots, rosettes, etc.) or sections and put them together in a fashion that will uniquely reflect his decorating style, ranging from the simplest treatment of one or two pieces to quite complex designs using any number of pieces and fabric patterns, and covering any size window. Also he will see exactly what the finished look is before purchasing and thereby save costly mistakes.

The fourth issue concerns the ease of mounting the valance pieces on the rod is accomplished by the hook and loop fastener. Hook and loop fasteners are employed to mount fabric window treatments in different applications. The term hook and loop fastener is the generic term used for fasteners such as Velcro fasteners. Velcro is a trademark of Velcro Industries, B.V. This process can be just as easy as threading on a rod pocket valance. A valance can be installed by the unskilled consumer as beautifully as it can be nailed or stapled on a board by a custom workroom.

Rod Sleeve

Figure 4:
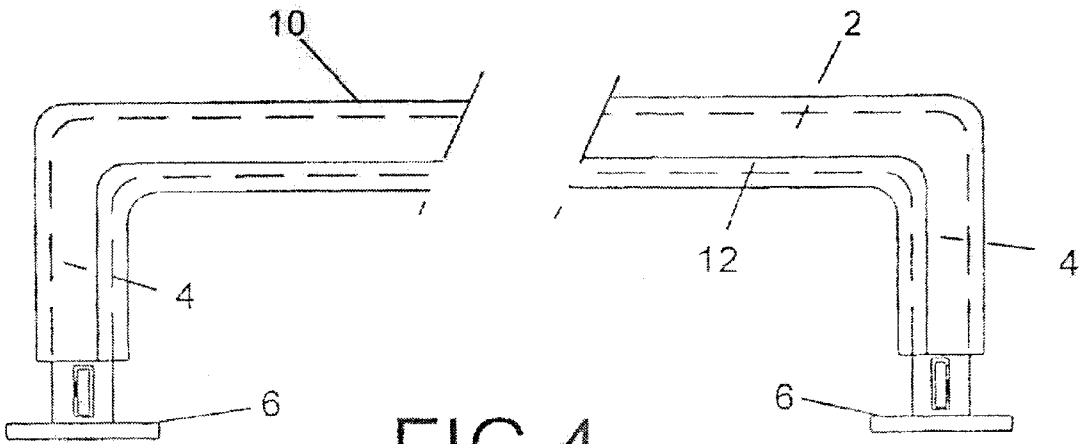
FIG. 4 is a view of a rod sleeve of the type shown in FIG. 3 positioned on a conventional curtain rod of the type shown in FIG. 1.
Figure 2:
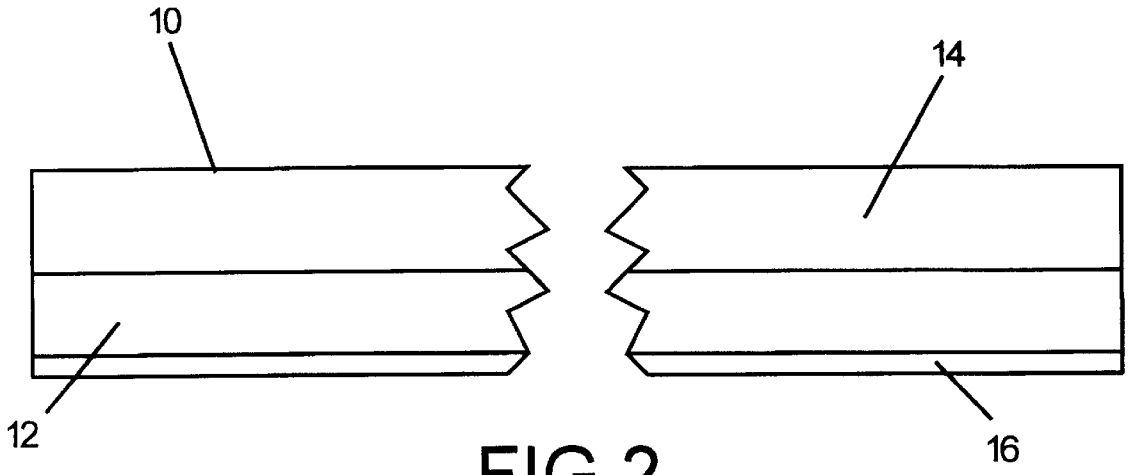
FIG. 2 is a view of a strip of heavy duty fabric with a hook fastener mounted thereon. This strip of fabric is used to form a rod sleeve that can be used on a conventional curtain rod of the type shown in FIG. 1.
Figure 3:
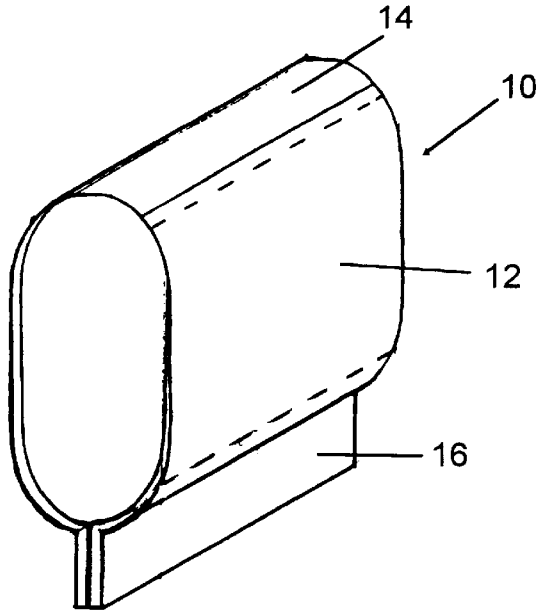
FIG. 3 is a view of a rod sleeve fabricated from the strip of fabric shown in FIG. 2.

The rod sleeve 10, shown in FIGS. 2–4, is fabricated from a flat strip 14 of relatively heavy fabric. A strip of hook fasteners 12 is sewn or otherwise attached to the fabric strip 14, and in the preferred embodiment the hook fastener strip 12 extends between opposite ends of the fabric strip 14 Although a loop fastener could be used instead of a hook fastener without departing from the basic concept of this invention, a hook fastener is preferred. This hook fastener strip 12 is not as flexible as the fabric strip 14 to which it is attached, so the hook fastener strip 12 will add rigidity to the rod sleeve 10 The height of the hook fastener strip 12 is less than one-half of the height of the fabric strip 14 to which it is attached. To complete construction of the rod sleeve 10, the fabric strip 14 is folded over about midsection to form a two ply configuration. The edges of the two sides 16 of the fabric strip 14 are then sewn or otherwise attached along a longitudinal line or seam adjacent one side of the hook fastener strip 12. Preferably the edges of the fabric are sewn together to form a longitudinal seam that extends along an edge of the hook fastener strip 12. When attached in this manner, the rod sleeve 10 forms a tubular fabric sleeve with an opening having a generally oblong cross section so that a telescoping curtain rod 2 having a rounded rectangular configuration can be inserted into the rod sleeve 10. The hook fastener strip 12 helps maintain the oblong configuration of the rod sleeve 10 so that the rod sleeve will not twist, turn or rotate on a conventional curtain rod 2 when a valance or fabric window treatment component is suspended from the rod sleeve 10 mounted on a telescoping curtain rod 2. The rod sleeve 10 can also be cut to length to fit telescoping curtain rods 2 of varying length. The rod sleeve 10, with the fabric fastener or hook fastener strip 12 attached, is sufficiently flexible so that the curtain rod 2 can be inserted through the rod sleeve 10. The rod sleeve 10 will also be sufficiently flexible to bend around the L-shaped configuration including the curtain rod returns 4 on the ends of the telescoping curtain rod 2. When used to mount the valances and window treatments according to this invention the hook fastener strip 12 is mounted on the inside of the curtain rod 2 so that the valance pieces must be draped over the top of the curtain rod and attached along the rear of the curtain rod 2. By attaching the valances or fabric window treatments in this manner, they will hang from a standard curtain rod 2 in the same way that custom made valances and fabric window treatments would hang from a board in a custom installation.

Adjustable-Width Valance Pieces

A conventional swag is a common part of a valance. Swags may be gathered on the top, forming a more casual look, or swags can be pleated. Gathered or pleated swags can be more generically referred to as drawn together swags, as can other gathered or pleated window treatments. Conventional swags (whether gathered or pleated) are made to be a definite size (i.e., a definite width and drop) and then mounted by staples, nails or the like to a board or pole. These conventional swags may even be removable (for cleaning, changing their placement or the board/pole for a different "look", etc.,) by means of hook and loop fasteners, etc. However in order for each removable swag to keep its desired form, the pleats or gathers are always sewn firmly in place to each swag itself and to the hook and loop fastener which then mates to the complementary hook and loop fastener on the board or pole.

The adjustable-width pleated swag 20, according to the present invention, is constructed so that it can have a variable span, preferably as much as six inches in width, giving it a lot of versatility in fitting different width windows. See FIGS. 5A–5D and FIG. 6. This adjustability feature is achieved by the critical placement of a complementary loop fastener pad 42 on the backside of the pleated area 28, or the area from which the folds 24 extend. FIG. 6 shows the backside of the pleated area 28 with the pleats or folds 24 located on the opposite side. Although the loop fastener pad 42 is located on the backside of the pleated area 28, the pad 42 is located on the decorative surface or face of the fabric forming the adjustable-width swag 20. When the upper pleated area 28 is folded over the top of a curtain rod 2, the pleats on the opposite side of the pleated area will be exposed and the loop fastener pad 42 will be positioned on the rear side of the curtain rod 2. The first loop pad 42 can then attached to a second hook fastener strip 30, which is on the top of the same swag 20, or the loop fastener pad 42 can be attached to a hook fastener strip on an adjacent or overlapping valance section. Loop fastener pad 42 can also be attached to a hook fastener strip 12 on the rod sleeve 10 covering the rod 2 from which the adjustable width pleated swag 20 is suspended. See FIGS. 1–3. The adjustable width swag 20 thus provides the option of attachment of the pleated sections 24, 26, 28 at the position that provides the desired width and design for the particular installation.

Figure 5A:
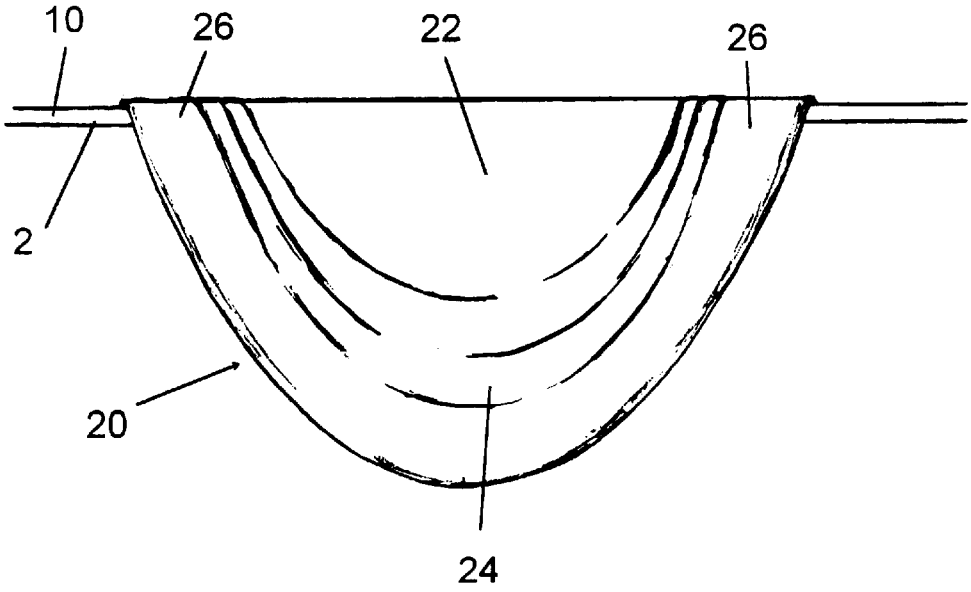
FIGS. 5A–5D are views of an adjustable width pleated swag that can be mounted on a conventional curtain rod on which a rod sleeve has been previously positioned.
Figure 5B:
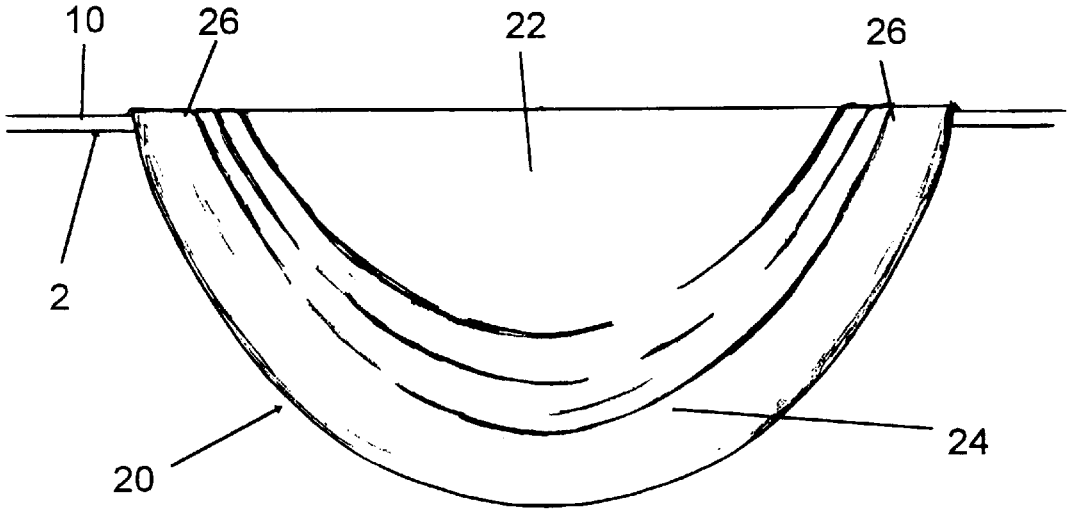
Figure 5C:
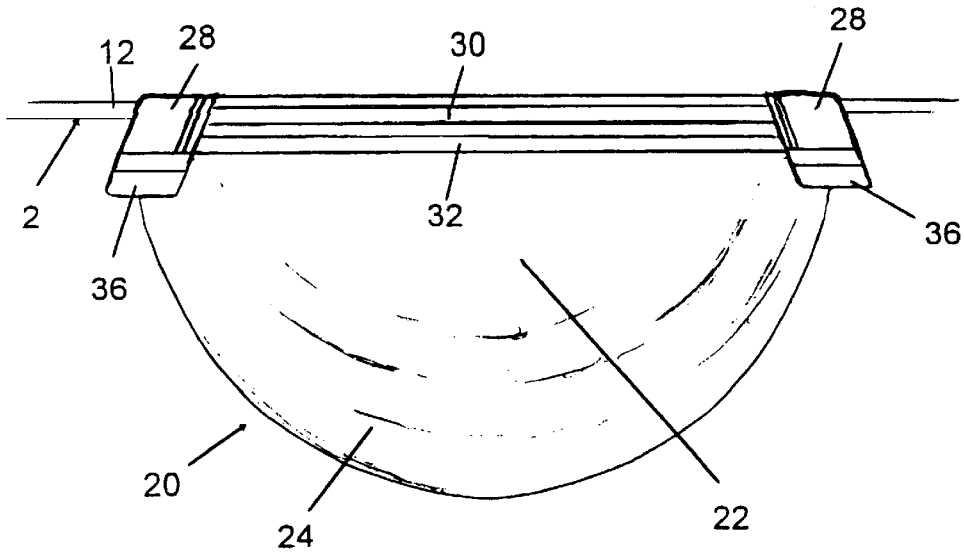
Figure 5D:
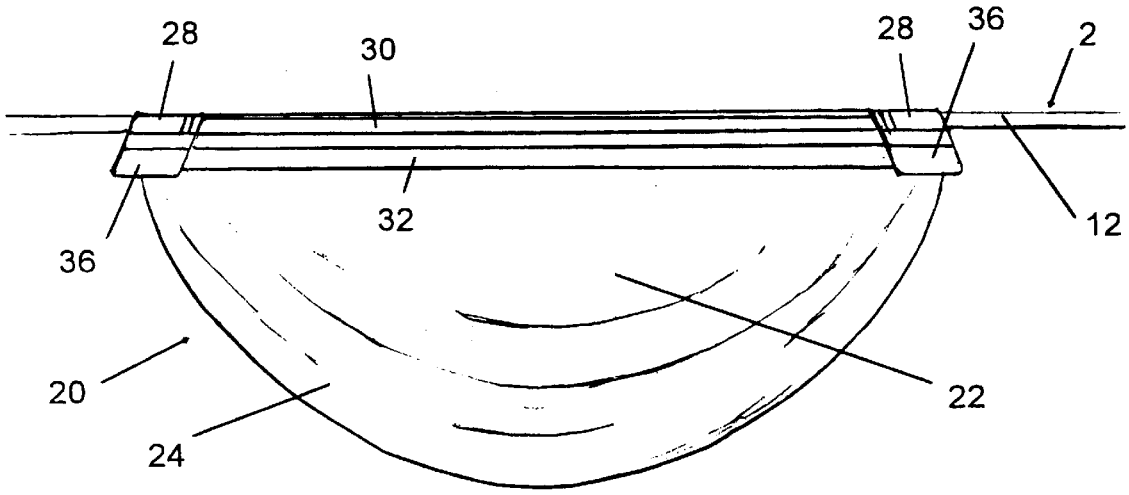
Figure 6:
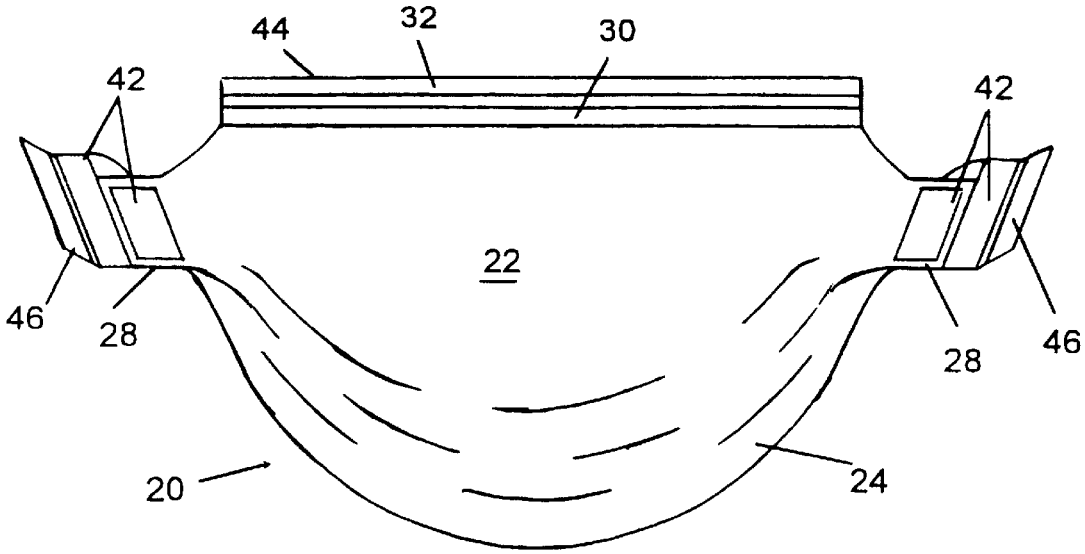
FIG. 6 is a view of a portion of an adjustable width pleated swag of the type shown in FIGS. 5A and 5B, showing details of the means for adjusting the width of the swag.

FIGS. 5A and 5C show opposite sides of an adjustable-width pleated swag 20 mounted on a curtain rod 2 with a rod sleeve 10. The first loop fastener pad 42, obstructed by the pleated ends 28 is fastened mostly, if not entirely, to a mating hook fastener strip 30 on the backside of the central section 22 of the adjustable width pleated swag 20 itself causing the width to be at its narrowest. FIGS. 5B and 5D show the same adjustable-width pleated swag 20 mounted on the same curtain rod 2 with the same rod sleeve 10, but at its widest span. In this case the first loop fastener pad 42 fastens itself almost entirely to the hook fastener strip 12 on the rod rear of the rod sleeve 10. The pleated area 28 with the loop fastener loop fastener pad 42 on the opposite side laps further over the back of the curtain rod 2 in order to achieve the narrower width shown in FIGS. 5A and 5C. The width of the same pleated swag 20 can be changed anywhere from 32" to 38" in this embodiment. Another possible range of width for a smaller swag could be from 24" to 30". These two sizes of the pleated adjustable-width swags 20 can be used to fit most windows beautifully.

FIG. 6 shows the front, decorative or face side or surface of the fabric used to construct the adjustable-width swag 20. A hook fastener strip 30 extends along the top of the central section 22. A protective flap 32, comprising a strip of loop fastener, is located between the hook fastener strip 30 and the upper edge of the central part of the swag 20. The protective flap is joined to the main fabric forming the pattern shown in FIG. 7 in the manner shown in FIG. 12. A similar protective flap 46 is located beyond each of the two complementary fastener pads 42 located at opposite ends of the pleated section. When the loop fastener pad 38, see FIG. 7, on the rear face of the swag 20 is attached to a hook fastener strip 12 on a rod sleeve 10, the central section will be draped over the curtain rod 2. The complementary loop fastener pads 42 on opposite edges of the drawn together pleated swag 20 can be attached either to the hook fastener strip 12 on the rod sleeve 10 or to the hook fastener strip 30 on the draped over decorative or face side of the adjustable width swag 20. The different lengths of the inner and outer loop fasteners forming the complementary fastener pads 42 permit engagement with wider or narrower sections of the hook fasteners to which these complementary pads 42 are to be attached in different installations.

This adjustability very much helps to achieve that great look of a custom fit while it simplifies the choices a customer needs to make when he or she is shopping for just the right size pieces. It also simplifies the manufacturing process since fewer size swags need to be produced, simplifying mass production, marketing and distribution.

Figure 7:
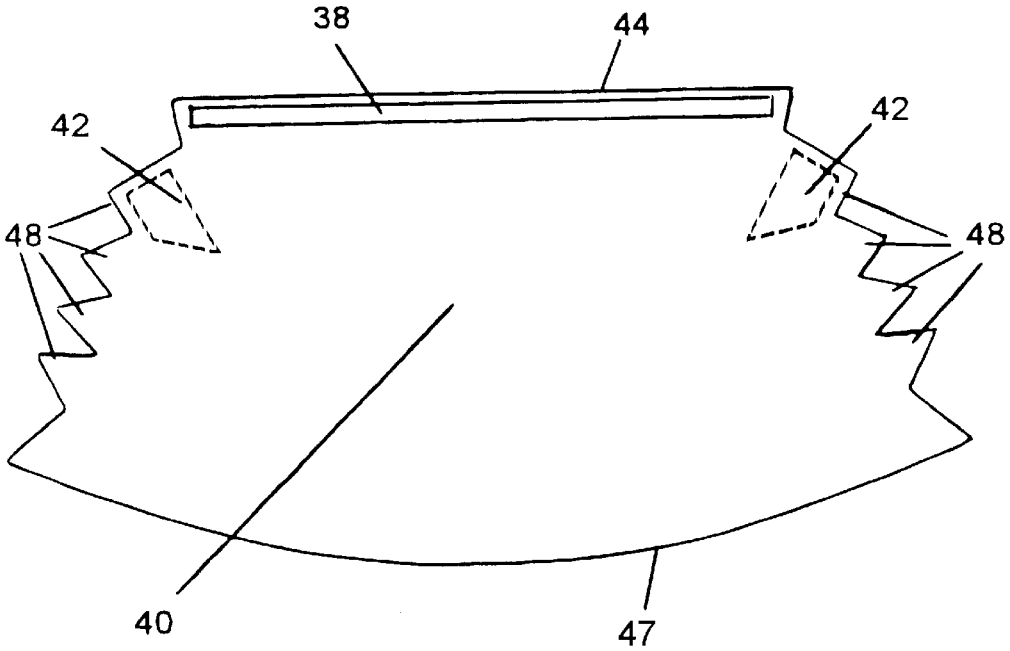
FIG. 7 is a view of a pattern from which the adjustable width swag of FIGS. 5A–5D and 6 can be fabricated.

FIG. 7 shows the pattern 40 from which the adjustable width pleated swag 20 is formed. The side opposite from the decorative or face side of the fabric is seen in FIG. 7. A loop fastener strip 38 extends adjacent the top edge 44 of the central section of this swag pattern 40. This loop fastener strip 38 can be attached to a hook fastener pad 12 on a rod sleeve 10 to form the primary means for suspending the adjustable width swag 40 from a curtain rod 2. The top edge 44 would be draped over the curtain rod 2 so that the loop fastener strip 38 could be secured to the hook fastener strip 12 extending along the rear of the curtain rod 2.

The fastener pads 42 would be located on the opposite side of the pattern shown in FIG. 7, but the position of fastener pads 42 is indicated the phantom lines. FIG. 7 shows a complementary loop fastener pad 42 having a trapezoidal shape. The corresponding complementary loop fastener pad 42 shown in FIG. 6 comprises two rectangular loop strips, one longer and narrower than the other. Either shape is satisfactory, and the size and shape of the raw loop fastener member used to construct the complementary pad 42 can dictate the final shape.

When the generally triangular sections 48 forming these serrated edges are positioned in overlapping relationship and secured together intervening folds or pleats will be formed between opposite edges of the swag 20. The uppermost triangular section on both ends protrudes laterally beyond the central rectangular section at the top of the swag pattern 40. The complementary loop fastener pad 42 is secured in this uppermost triangular section on the front or decorative surface, but on the backside of the pleated area. This loop fastener pad 42 is located laterally beyond the central rectangular section, and the hook fastener strip 30 located on the front surface of that central rectangular section. After the pleats have been drawn together, this uppermost triangular section and the loop fastener pad 42 located thereon will be on an exposed surface of the pleated or drawn together portion of the swag 20. This uppermost segment with the exposed loop fastener pad 42 can then be draped over the curtain rod 2 so that the loop fastener pad 42 can be positioned to grip the hook fastener strip 12 on the rear surface of the curtain rod assembly, which in the preferred embodiment includes the rod sleeve 10. The exposed loop fastener pad 42 can also be positioned to grip the hook fastener strip 30 on the exposed decorative side of the central rectangular section of the swag 20. In some installations, the loop fastener pad 42 can engage hook fastener strips on adjacent or overlapping fabric window treatment components. The hook fastener strip 42 on the exposed surface of the swag may be aligned with the hook fastener strip 12 on the rod sleeve 10 or rod when the swag is mounted on the rod at its widest extension. A continuous, aligned hook fastener ribbon may then be formed and the loop fastener pad 42 can be attached at any lateral position within the reach of the pleated material, thus imparting the width-adjustment capability to this drawn together fabric window treatment. Of course the drop of the swag 20 will also be dependent upon the position of the loop fastener pad 42, and therefore on the installed width of the swag. Since the attachment means including all of the hook and loop fastener means will be located on the rear of the curtain rod assembly, this attachment and adjustment means will not be visible from the front of the swag. It follows therefore that the width-adjustable pleated swag can be easily assembled by a homeowner, and the individual swags need not be prefabricated to a specific width or size.

Figure 8:
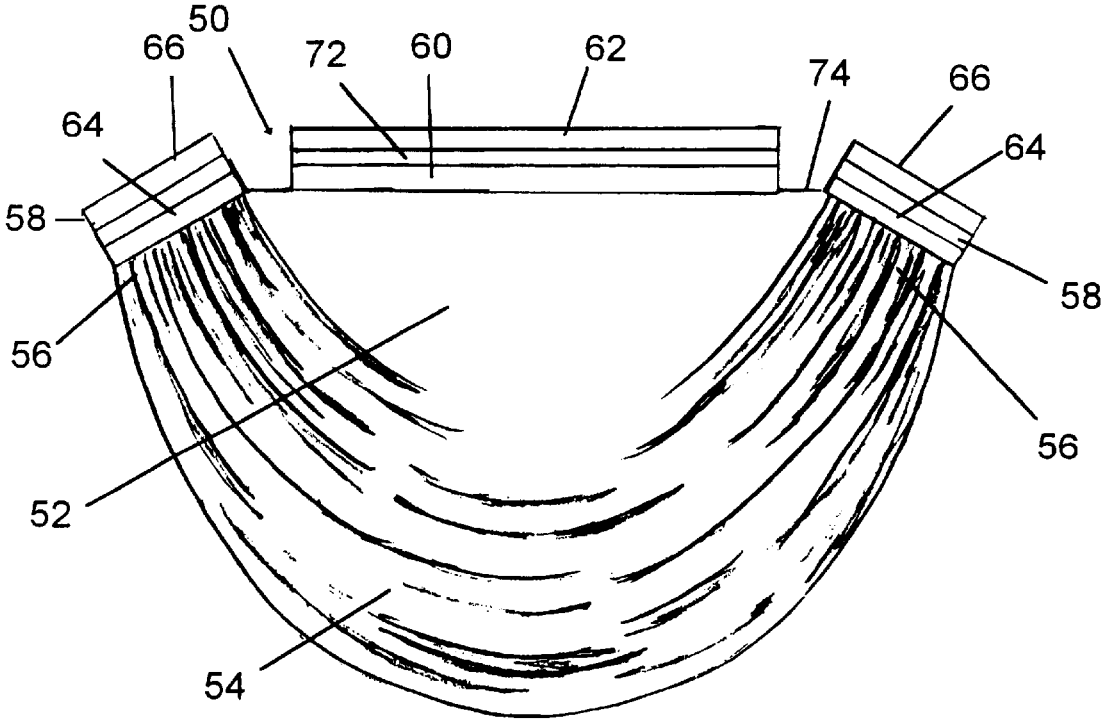
FIG. 8 is a view of an alternate embodiment of a fabric window treatment in the form of an adjustable width gathered swag.
Figure 9:
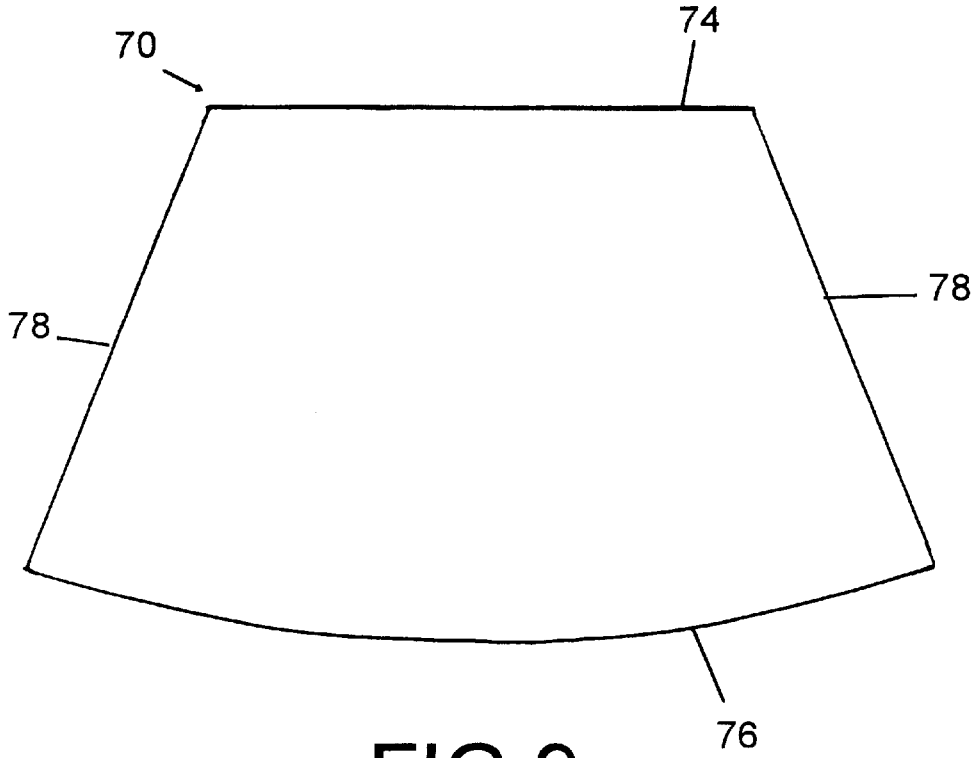
FIG. 9 is a view of a pattern from which the adjustable width gathered swag of FIG. 8 can be fabricated.

Other drawn together, width-adjustable valance pieces can be fabricated in a similar manner. FIG. 8 shows an adjustable-width gathered swag 50, and FIG. 9 shows the pattern 70 for fabricating this adjustable-width gathered swag 50. This adjustable gathered swag includes a central rectangular section 72 similar to the adjustable pleated swag, with a parallel hook fastener strip 60 and loop fastener strip 62 located on the decorative face of this central rectangular section. A loop fastener strip is located on the opposed rear surface. Folds 54, extending around central section 52 of this gathered swag 50, are formed by drawing together fabric along inclined edges 78 of the fabric formed by this gathered swag pattern 70 and by sewing or otherwise securing these gathered ends to separate pieces of material 58 on which a loop fastener pad 64 has been secured. The fabric is gathered by overlapping sections of fabric side to side to form the gathered section 56 to which a hook fastener pad 64 is attached. A loop fastener pad, on the opposite side of the fabric and generally at the same elevation as the hook fastener pad 64, can then be attached to the hook fastener strips 12 on the rod sleeve 10 or to the auxiliary hook fastener strip 60 located on the rear, exposed, decorative surface or face of the fabric when draped over a curtain rod to adjust the width of the drawn together, gathered portion of the adjustable gathered swag 50 in substantially the same manner as for the adjustable pleated swag. A protective flap 66 including a loop fastener strip is sewn adjacent to the hook fastener pad 64. The pattern includes an upper edge 74 and a curved lower border 74. The diverging side edges 78 can be straight, because the fabric is laterally drawn together to form the final gathered configuration. It should be noted that the side section of the gathered swag 50 are not flipped over when mounted on a curtain rod in the same manner as for the pleated swag 20. With the gathered swag, these side section are merely adjusted laterally.

Figure 10:
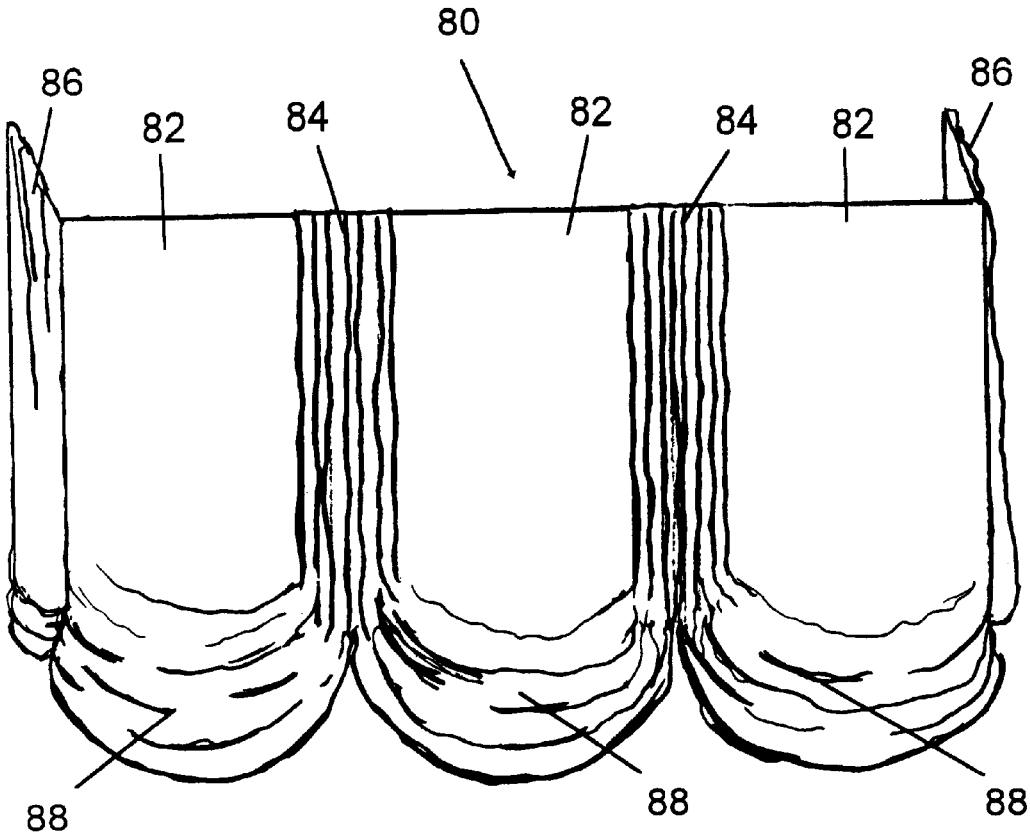
FIG. 10 is a view of another alternate embodiment of a fabric window treatment in the form of a balloon that includes both width and length adjustment.
Figure 11A:
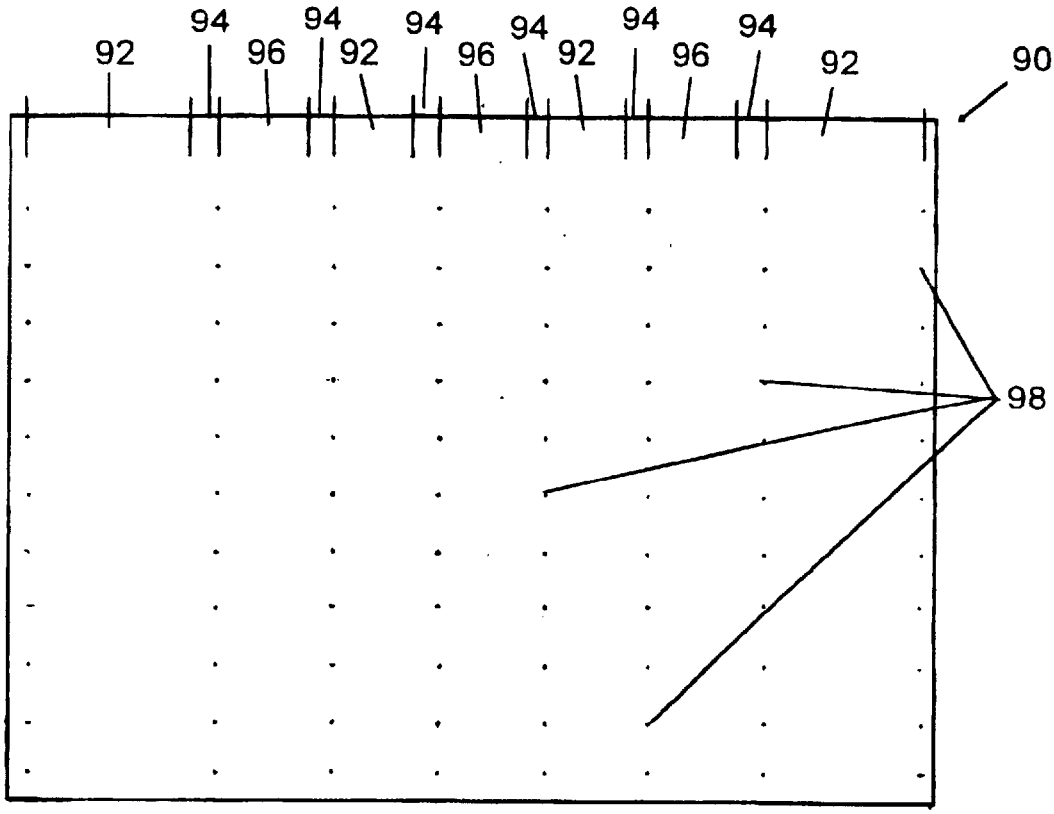
FIG. 11A is a view of a pattern from which the balloon fabric window treatment of the type shown in FIG. 10 can be constructed.

A balloon window treatment 80 shown in FIG. 10 is an example of a drawn together fabric window treatment in which the width and the length can be independently adjusted. A balloon pattern 90 is shown in FIG. 11A. The adjustable balloon that can be mounted on the same hook fastener strip 12 on a rod sleeve 10 or similar rod assembly of the same type as used to mount the adjustable swags. The balloon 80 includes a loop fastener strip assembly across the top edge of this fabric window treatment. Some of the segments of this balloon fabric comprise gathered sections 92 will include loop fasteners, not shown, that can be collapsed in an accordion style fashion. These collapsible loop fastener strips are available from Rowley Co. Draw strings extend through these collapsible loop fastener strips so that when the string are pulled the width of the collapsible loop segments is reduced. Conventional flat loop fastener strips are located in sections 96 between the collapsible segments 92 in portions of the balloon fabric window treatment that are to remain substantially flat. Box pleat sections 94, with permanently attached pleats, which lap toward and under adjacent flat segments 96, are also located along this top edge. The top edge of the balloon can be draped over the top of a curtain rod 2 assembly, and the adjustable width balloon 80 can be secured to hook fastener strips 12 located on the rearwardly facing side of the curtain rod or of the rod sleeve 10 mounted on that curtain rod in substantially the same fashion as the drawn together swags. This configuration results in a balloon window treatment having flat sections 82 with laterally gathered section 84, corresponding to the collapsible segments 92 and box pleat sections 94, located under and on either side of these flat sections 82. Loop fasteners are located in each section, including return sections 86, so that the balloon 80 can be suspended from a curtain rod 2 along substantially its entire width.

Figure 11B:
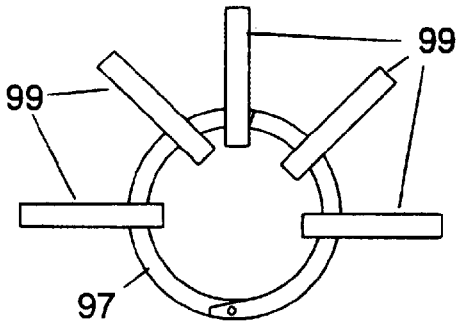
FIGS. 11B and 11C show the snap rings and fabric rings or loops that can be used to adjust the length of the balloon fabric window treatment or with other fabric window treatments.
Figure 11C:
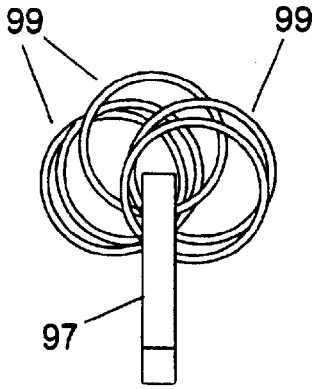

The length of the balloon 80 can be adjusted by the homeowner by the use of a snap ring 97 shown in FIGS. 11B and 11C. Loops 99 are fixedly attached to the rear of the balloon at the positions 98 shown on the balloon pattern 90 in FIG. 11A. Snap rings 97 are then used to gather all of the collinear loops 99 extending between the top and bottom. To lengthen the balloon 80, loops 99 adjacent the top of the balloon 80 can be disengaged from snap rings 97 to which the remainder of the loops 99 remain attached. The snap rings 97 and the loops 99 can be employed on other window treatment pieces, such as a drapery panel. In this case the loops 99 would usually be disengaged from the snap ring 97 starting at the bottom of the panel.

Protective Flap

The adjustable window treatment system offers the opportunity to quickly mount or remove any of the valance pieces. This protective flap feature comes into play quite often for those sections, which are washable, but it is also necessary for those pieces, which are to be dry cleaned. To ensure that the hook fastener portion (which is sewn to one side of each valance piece so another piece can be attached to it) does not harm the fabric when it is cleaned, each piece, which is washable/dry cleanable, is especially constructed as follows. The section of the fabric to which the hook fastener strip is attached extends beyond the hook fastener strip to allow a loop fastener strip to be placed parallel to the hook fastener strip between the edge of the fabric and the hook fastener strip. A mating loop fastener strip has been sewn onto this extension forming a protective flap. The flap can be folded down over the mating hook strip so the hook portion is covered during cleaning.

Figure 12:
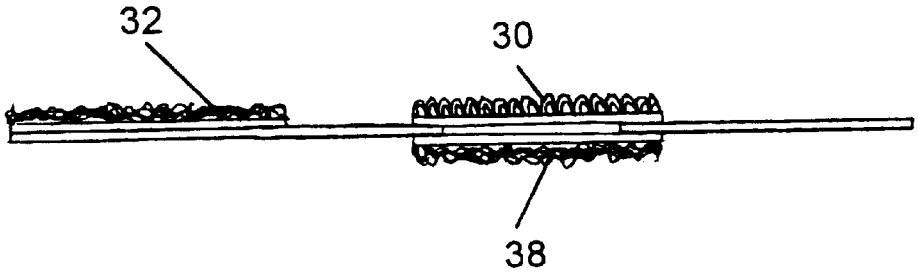
FIG. 12 is a view of a protective flap that can be used with the fabric window treatments employing hook fasteners for adjusting sections of a window treatment or for attachment of adjacent fabric window treatments in partially overlapping configuration.

FIG. 12 shows one example of the construction of a protective flap. Protective flap 32 is, in this example, attached along side of a hook fastener strip 30, which is attached along the edge of the primary fabric on the adjustable width pleated swag 20. A hook fastener strip and a loop fastener strip 38 are sewn along oppositely facing surfaces at the edge of the primary fabric. The protective flap includes a loop fastener strip 32 sewn to a separate piece of fabric, one edge of which extends beyond the loop fastener strip. This laterally extending end of the fabric is sewn between distal edges of the hook fastener strip 30 and the loop fastener strip 38. The protective flap loop fastener strip 32 extends parallel to the hook fastener strip 30 and the loop fastener strip 38, which comprises the primary means for attaching the swag 20 to a rod sleeve 10 on a curtain rod 2. The protective flap loop fastener strip 32 faces in the same direction as the auxiliary hook fastener strip 30. When the window treatment or swag 20 is to be cleaned or stored, the protective flap is folded over the auxiliary hook fastener strip 30 on the fabric to cover the hook fasteners so that they do not damage the fabric during handling or cleaning. A similar protective flap construction could be used at other positions on a window treatment fabric, including fabrication of the protective flap 46 located on the edge of the pleated area 28 or protective flap 66 on the gathered swag 50 shown in FIG. 8.

Completed Window Treatment

Figure 13:
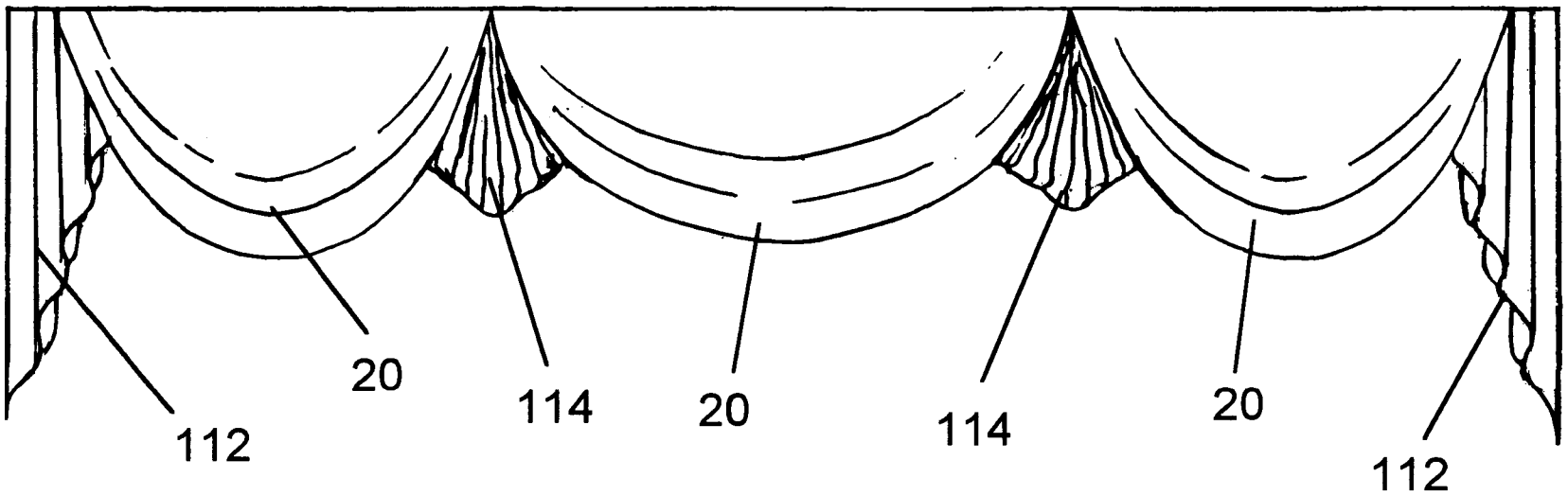
FIG. 13 is a view of a window treatment assembly including multiple fabric window treatments mounted on a standard curtain rod.

FIG. 13 is a representative view of a completed window treatment including several standard components. In this example, three adjustable width pleated swags 20 have been placed side by side over a single window. Each swag 20 is hung from a curtain rod 2, shown in FIG. 1, over which a rod sleeve 10, shown in FIGS. 2–4, has been inserted. In order to fit the window in question, the middle swag has been expanded to its maximum width and it drop is at its minimum, as shown in FIGS. 5B and 5D. The two outermost swags have been installed at their narrowest width, with a corresponding maximum drop, and correspond to the configuration shown in FIGS. 5A and 5C. The differences in width and drop have been exaggerated in FIG. 13 for illustration purposes. In an actual installation, the maximum and minimum drops would differ by only approximately one inch and would not normally be noticeable. Of course, the three swags would probably be adjusted so that they would span the same width, and would there have an even drop. FIG. 13 is intended only to show the versatility of this approach. In addition to the swags 20, additional components have been added to this example. Cascades 112 have been added at each end. These cascades can be attached to the portion of the rod sleeve 10 extending around the curtain rod return 4. See FIGS. 1–4. A loop fastener would be attached to the top of the cascade, and it would function in the same manner as the primary loop strip 38 on adjustable swag 20. This cascade loop fastener could be attached either to the rod sleeve hook strip 12 or to the hook fastener strip 30 on the adjacent swag 20, or to both hook fastener strips. A hook fastener strip and accompanying protective flap could also be added to the other side of the cascade 112. Decorative jabots 114 are shown attached between adjacent swags 20, covering the intersection of these fabric window treatment components. These jabots are draped over the curtain rod in the same fashion as the swags. Loop fastener strips would be located at the top of the jabots to attach to the hook fastener strips 12 or 38 between the curtain rod 2 and the wall above the window. Other decorative accessories, such as rosettes, could be used in a similar manner.

Adjustable-Width Valance Support Device

Figure 14A:
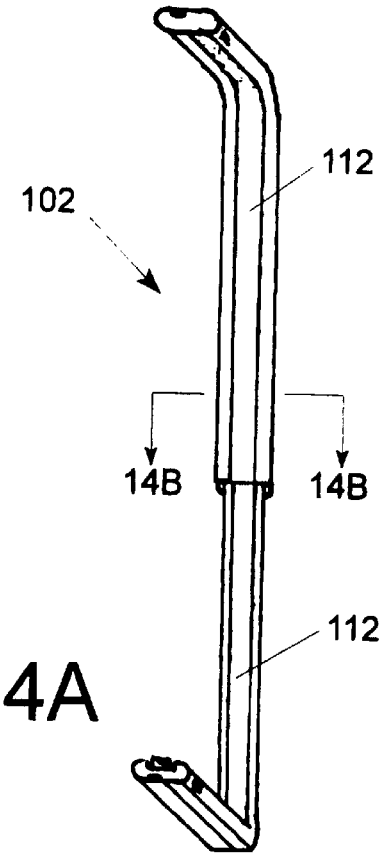
FIGS. 14A and 14B are views of an adjustable width curtain rod including hook and loop fasteners permanently bonded as part of the telescoping curtain rod components.
Figure 14B:
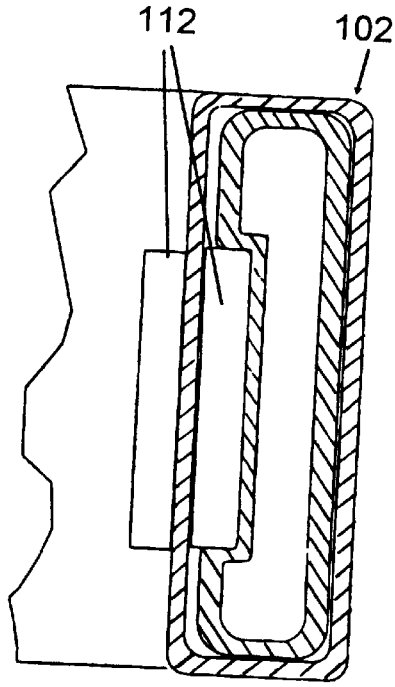

The adjustable valance pieces of the window treatment system of this invention can be mounted on other curtain rod assemblies, and are not limited to use with a rod sleeve 10 according to the preferred embodiment of this system. An adjustable-width valance support device 102 that is part of the decorative window treatment system of the instant invention is similar in design to the common curtain rod illustrated in FIGS. 14A and 14B with certain exceptions. First, the width of the rod is greater than the standard. It is a minimum of 1⅛". The second exception is that it incorporates a hook and loop attachment system. A 1" wide strip of hook fastener material 108, is secured to the back side (the side which faces the wall or window) of both the outer and inner portions of the telescoping rod 102. The material is recessed in the inner portion of the rod so that the telescoping action is uninhibited. A 1" wide strip of hook fastener material (rather than ½" or ¾" width) is necessary to reliably secure the valance pieces to the rod without risk of inadvertent detachment. The Adjustable-Width Valance Support Device 102 (the basic rod, fabricated of metal, plastic, wood, or other material) will be manufactured in varying lengths to accommodate most any window or wall area which the customer desires to cover or decorate.

The embodiment depicted herein are representative of adjustable window treatments that can be hung from a conventional curtain rod or other rod, but will have the same appearance as custom made window treatment fabrics nailed to a board. The examples depicted herein are only representative in nature. Other decorative configurations can employ the invention as disclosed herein and these other configurations can be used alone or in combination with the adjustable window treatment fabrics described herein. The invention is therefore defined by the following claims and are not limited explicitly to the examples depicted herein.

I claim:

1. A fabric window treatment suspendable from a telescoping curtain rod located at the top of a window comprising:

an adjustable fabric with folds drawn-together at opposite ends of the fabric:

a laterally extending fastener extending adjacent a top edge of the fabric and attached to the fabric, the fastener comprising means for attaching the fabric to the rod along most of the width of the fabric:

a complementary fastener at each end of the fabric, comprising one of a hook or a loop fastener, affixed to the fabric at opposite ends where the folds are drawn together, the complementary fastener being attachable along the top edge of the adjustable fabric between opposite ends of the adjustable fabric and on an opposite side of the adjustable fabric from the laterally extending fastener to comprise means for adjusting the size and shape of the of the fabric by positioning the folds at different positions relative to the top edge of the fabric, whereby the fabric window treatment can be mounted on a telescoping curtain rod and adjusted to fit windows of differing sizes.

2. The fabric window treatment of claim 1 wherein the complementary fasteners are located laterally beyond opposite ends of the laterally extending fastener located adjacent the top edge of the fabric for adjusting the width of the window treatment.

3. The fabric window treatment of claim 1 wherein the laterally extending fastener located adjacent the top edge of the fabric comprises a loop fastener.

4. The fabric window treatment of claim 3 wherein the laterally extending loop fastener located adjacent the top edge of the fabric is located on one side of the fabric and a hook fastener strip is located on an opposite side of the fabric at the same elevation of the loop fastener located adjacent the top edge of the fabric so that additional fabric window treatments can be attached in contact with the fabric window treatment.

5. The fabric window treatment of claim 4 wherein the complementary fastener comprises a loop fastener that can be attached at least partially to the hook fastener on the fabric to hang the fabric in a configuration having its minimum width.

6. The fabric window treatment of claim 5 including a protective flap that can be folded over the hook fastener located adjacent the top edge of the fabric to prevent damage to the fabric window treatment during cleaning.

7. The fabric window treatment of claim 6 wherein the protective flap is located along the top edge of the above the loop fastener.

8. The fabric window treatment of claim 6 wherein the protective flap includes a loop fastener.

9. The fabric window treatment of claim 1 wherein the fabric comprises a valance piece.

10. The fabric window treatment of claim 1 wherein the fabric with drawn-together folds comprises a swag.

11. The fabric window treatment of claim 1 wherein each complementary fastener comprises a single continuous pad to which all of the drawn together folds at each end of the fabric are attached.

12. A window treatment system comprising:

a rod sleeve attachable to a telescoping curtain rod, the rod sleeve comprising a fabric member including a tubular sheath for receiving the curtain rod and an elongate fabric fastener means permanently mounted on an exterior vertical surface of the rod sleeve; and a valance piece attachable to the rod sleeve, the valance piece including a fastener strip located adjacent the top of the valance, the fastener strip being attachable to the fabric fastener means on the rod sleeve, the fastener strip and the fabric fastener means comprising means for mounting the valance on the rod sleeve with the valance draped over the telescoping curtain rod.

13. The window treatment system of claim 12 wherein the valance piece includes a valance fabric fastener mounted on an opposite side of the valance piece from the fastener strip, the valance fabric fastener comprising means for attaching an adjoining valance piece thereto when two valances are mounted on the curtain rod.

14. The window treatment system of claim 12 wherein the fabric fastener mean comprises a hook fastener and the fastener strip comprises a loop fastener.

15. The window treatment system of claim 12 wherein the valance piece includes width adjustment means for adjusting the width of the valance to fit windows of different sizes.

16. The window treatment system of claim 15 wherein the width adjustment means comprises a loop fastener attached to the hook fastener means on the rod sleeve at differing positions to adjust the overall installed width of the valance piece.

17. A rod sleeve for use in suspending a window treatment fabric from a telescoping curtain rod, the rod sleeve comprising;

a tubular fabric sleeve formed from a fabric piece, the tubular fabric sleeve having a central tubular opening extending between opposite ends of the fabric sleeve, the central tubular opening having a size sufficient for insertion of a telescoping curtain rod through the tubular opening so that the tubular fabric sleeve will envelope the telescoping curtain rod and having a generally oblong cross section so that the tubular fabric sleeve will not rotate relative to the curtain rod when installed thereon;

an elongate fabric fastener permanently mounted on an exterior vertical surface of the tubular fabric sleeve, the tubular fabric sleeve and the fabric fastener being sufficiently flexible to fold around an L-shaped curtain rod member so that the fabric fastener can be positioned between the telescoping curtain rod and a wall on which the curtain rod is attached so that a window treatment fabric can be draped over the curtain rod and attached along a rear surface of the telescoping curtain rod.

18. The rod sleeve of claim 17 wherein the fabric fastener comprises one of a hook and loop fastener.

19. The rod sleeve of claim 18 wherein a hook fastener extends between opposite ends of the rod sleeve.

20. The rod sleeve of claim 17 wherein the fabric fastener is more rigid than the piece so that the fabric fastener helps maintain the oblong cross section of the tubular sleeve.

* * * * *